US009804535B2

(12) United States Patent
Kakehi

(10) Patent No.: US 9,804,535 B2
(45) Date of Patent: Oct. 31, 2017

(54) IMAGE FORMING APPARATUS

(71) Applicant: CANON KABUSHIKI KAISHA, Tokyo (JP)

(72) Inventor: Yutaka Kakehi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/175,583

(22) Filed: Jun. 7, 2016

(65) Prior Publication Data

US 2016/0370737 A1 Dec. 22, 2016

(30) Foreign Application Priority Data

Jun. 19, 2015 (JP) ..... 2015-124201

(51) Int. Cl.
*G03G 15/16* (2006.01)

(52) U.S. Cl.
CPC ..... *G03G 15/161* (2013.01); *G03G 15/1615* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,697,595 | B2 | 2/2004 | Kawagoe et al. | |
| 8,787,805 | B2 | 7/2014 | Nakajima | |
| 9,229,374 | B2 | 1/2016 | Kakehi | |
| 9,348,266 | B2 | 5/2016 | Kakehi | |
| 2002/0034406 | A1 | 3/2002 | Kawagoe et al. | |
| 2007/0297829 | A1 | 12/2007 | Kurosu et al. | |
| 2009/0324306 | A1* | 12/2009 | Echigo | G03G 15/1605 399/314 |
| 2011/0255909 | A1* | 10/2011 | Tomura | G03G 15/0131 399/308 |

(Continued)

FOREIGN PATENT DOCUMENTS

| | | | |
|---|---|---|---|
| JP | 11-24444 | A | 1/1999 |
| JP | 2002-082543 | A | 3/2002 |

(Continued)

OTHER PUBLICATIONS

Extended European Search Report dated Nov. 2, 2016 in European Patent Application No. 16173759.8.
U.S. Appl. No. 15/160,181, filed Aug. 29, 2016, Yutaka Kakehi.

*Primary Examiner* — Clayton E LaBalle
*Assistant Examiner* — Jas Sanghera
(74) *Attorney, Agent, or Firm* — Fitzpatrick, Cella, Harper & Scinto

(57) ABSTRACT

An image forming apparatus includes a movable endless belt, an image forming unit, a plurality of rollers including a first roller and a second roller, and an urging member. The urging member is provided on an inner peripheral surface side at a position which is adjacent to and upstream of the first roller and which is downstream of the second roller with respect to a movement direction of the belt. The urging member is supported at an upstream end portion thereof with respect to the movement direction of the belt and includes a first urging portion and a second urging portion at two different positions with respect to the movement direction of the belt. The first urging portion and the second urging portion urge the belt along a widthwise direction crossing the movement direction of the belt.

14 Claims, 6 Drawing Sheets

(56) References Cited

U.S. PATENT DOCUMENTS

| | | | |
|---|---|---|---|
| 2012/0207522 | A1 | 8/2012 | Nakajima |
| 2015/0286166 | A1 | 10/2015 | Kokubo et al. |
| 2015/0346645 | A1 | 12/2015 | Kakehi |
| 2016/0091835 | A1 | 3/2016 | Murayama |

FOREIGN PATENT DOCUMENTS

| | | | | | |
|---|---|---|---|---|---|
| JP | 2012-168396 | A | | 9/2012 | |
| JP | 2013-218244 | A | | 10/2013 | |
| JP | 2013218244 | A | * | 10/2013 | ..... G03G 15/14 |
| JP | 2016-066016 | A | | 4/2016 | |

* cited by examiner (a)

(b)

IMAGE FORMING APPARATUS

FIELD OF THE INVENTION AND RELATED ART

The present invention relates to an image forming apparatus, such as a copying machine, a printer or a facsimile machine, using an electrophotographic type or an electrostatic recording type in which an endless belt for feeding a toner image to a transfer portion while carrying the toner image, and relates to an urging member, for urging the endless belt, used in the image forming apparatus.

Conventionally, in the image forming apparatus using the electrophotographic type or the electrostatic recording type, the toner image is formed on an image bearing member (first image bearing member) such as an electrophotographic photosensitive member or an electrostatic recording dielectric member by an appropriate image forming process. This toner image is directly transferred onto a recording material or is secondary-transferred onto the recording material after being once primary-transferred onto an intermediary transfer member (second image bearing member). As the intermediary transfer member, an endless belt (intermediary transfer belt) is used in many cases. As the photosensitive member or the electrostatic recording dielectric member, an endless belt (photosensitive (member) belt, electrostatic recording dielectric (member) belt) is used in some cases.

Further description will be made using an electrophotographic image forming apparatus of an intermediary transfer type in which an intermediary transfer belt is provided, as an example. The toner image formed on the photosensitive member is primary-transferred onto the intermediary transfer belt at a primary transfer portion and thereafter is secondary-transferred onto the recording material such as paper at a secondary transfer portion. At the secondary transfer portion, for example, a secondary transfer member such as a secondary transfer roller is provided at a position opposing one of stretching rollers for the intermediary transfer belt via the intermediary transfer belt and thus the secondary transfer portion is formed by sandwiching the intermediary transfer belt by the stretching roller and the secondary transfer member. Then, by applying a voltage to the secondary transfer member or the stretching roller, an electric field is formed at the secondary transfer portion, so that the toner image is secondary-transferred from the intermediary transfer belt onto the recording material supplied to the secondary transfer portion. At this time, when the electric field at the secondary transfer portion is excessively strong, by electric discharge, opposite electric charges are imparted to the toner. In this way, such a phenomenon that the toner having an electric charge amount which was close to 0 is not transferred onto the recording material but an image at that portion is removed as a white portion (white void) occurs in some cases. This phenomenon is liable to occur with a stronger electric field formed at the secondary transfer portion, and therefore referred to as "strong removal (of image by electric field)". Further, this strong removal is different in level depending on a state in which the toner is subjected to a load. An external additive of the toner has the function of lowering a depositing force between the toner and another object. For this reason, a toner which is subjected to many loads and from which the external additive is peeled off increases in depositing force on the intermediary transfer belt, so that the strong removal is more liable to be visualized.

The strong removal is liable to generate in the case where the electric field at the secondary transfer portion is excessively strong, and therefore it would be considered that a transfer voltage supplied for secondary transfer is minimized and thus the strong removal can be suppressed. However, when the transfer voltage is made excessively small, the toner for a high density image cannot be sufficiently secondary-transferred, so that an image quality of the high density image formed on the recording material is impaired in some cases.

The electric discharge causing the strong removal in the neighborhood of the secondary transfer portion is liable to generate when a gap (discharge gap) is formed between a toner image carrying surface of the intermediary transfer belt and a surface where the toner image is to be transferred onto the recording material. When the intermediary transfer belt causes waving in the neighborhood of the secondary transfer portion, the above gap is liable to generate, so that a degree of the strong removal worsens. For that reason, the strong removal can be suppressed by suppressing the waving of the intermediary transfer belt in the neighborhood of the secondary transfer portion.

In order to suppress the waving of the intermediary transfer belt, a tension with which the intermediary transfer belt is stretched by a stretching means may only be required to be made strong (large). However, in order to sufficiently suppress the waving, of the intermediary transfer belt in the neighborhood of the secondary transfer portion, which largely affects the image quality, placement of an urging member contacting an inner peripheral surface (back surface) of the intermediary transfer belt in the neighborhood of the secondary transfer portion is more effective.

Japanese laid-Open Patent Application 2002-82543 proposes a constitution in which a sheet(-like) member is contacted to a back surface of an intermediary transfer belt in the neighborhood of a secondary transfer portion.

However, in the case where thick paper or the like which is thick and which has high rigidity is used as the recording material, an impact when a leading end of the recording material with respect to a feeding direction enters the secondary transfer portion is large, so that waving of the intermediary transfer belt cannot be sufficiently suppressed even by the urging member in some cases. Further, only at a loading end portion of the recording material, a gap is formed in some cases between the recording material and the intermediary transfer belt.

Further description will be made with reference to FIG. 6. An urging member 210 shown in FIG. 6 includes a sheet 211 contacting a back surface of an intermediary transfer belt 207. The sheet 211 contacts the back surface of the intermediary transfer belt 207 at a free end portion (contact portion) 210*a* of a free end thereof. The urging member 210 is configured to push back, at the contact portion 210*a*, a pushing force for pushing the intermediary transfer belt 207 by a recording material P, so that it is desirable that the recording material P enters a secondary transfer portion N2 in a state in which the leading end portion of the recording material P is closely contacted to the intermediary transfer belt 7. As a result, the gap between the surface of the intermediary transfer belt 7 and the surface of the recording material P in the neighborhood of the secondary transfer portion N2 is eliminated or decreased, so that the strong removal due to the electric discharge in the neighborhood of the secondary transfer portion N2 can be suppressed.

However, when an impact when the recording material P enters the secondary transfer portion N2 is large, the urging member 210 is influenced by the impact and thus moves in a direction in which the urging member 210 escapes from the recording material P at the contact portion 210*a* in some cases. Further, in the neighborhood of the contact portion 210*a*, the intermediary transfer belt 7 causes waving, so that the leading end portion of the recording material P and the intermediary transfer belt 7 cannot closely contact each other and thus a gap is formed therebetween in some cases. Due to electric discharge between the recording material P and the intermediary transfer belt 7 in this gap, a phenomenon (white void) that the image is removed as a white portion and a phenomenon (scattering) that the toner scatters in an electric field generate only at the leading end portion of the recording material P. Hereinafter, an image defect, such as the white void or the scattering, generating at the leading end portion of the recording material is also referred to as a leading end portion image defect.

The leading end portion image defect also generates in the case where the urging member is not provided in the neighborhood of the secondary transfer portion. However, in the case where the urging member is provided, between the leading end portion of the recording material and another portion, a degree of ease of formation of the gap between the recording material and the intermediary transfer belt is largely different, and therefore there is a tendency that the image defect at the leading end portion becomes more conspicuous.

SUMMARY OF THE INVENTION

According to an aspect of the present invention, there is provided an image forming apparatus comprising: a movable endless belt; an image forming unit configured to form a toner image on the belt; a plurality of rollers configured to stretch the belt at an inner peripheral surface side of the belt, wherein the rollers include a first roller configured to form a transfer portion where the toner image is transferred from the belt onto a recording material and a second roller provided at a position and in an upstream side of the first roller with respect to a movement direction of the belt; and an urging member configured to urge the belt toward an outer peripheral surface side of the belt in contact with an inner peripheral surface of the belt, wherein the urging member is provided in the inner peripheral surface side at a position which is adjacent to and upstream of the first roller and which is downstream of the second roller with respect to the movement direction of the belt, and wherein the urging member is supported at an upstream end portion thereof with respect to the movement direction of the belt and includes a first urging portion and a second urging portion at two different positions with respect to the movement direction of the belt, the first urging portion and the second urging portion urging the belt along a widthwise direction crossing the movement direction of the belt.

According to another aspect of the present invention, there is provided an image forming apparatus comprising: a movable endless belt; an image forming unit configured to form a toner image on the belt; a plurality of rollers configured to stretch the belt at an inner peripheral surface side of the belt, wherein the rollers include a first roller configured to form a transfer portion where the toner image is transferred from the belt onto a recording material and a second roller provided at a position and in an upstream side of the first roller with respect to a movement direction of the belt; and an urging member configured to urge the belt toward an outer peripheral surface side of the belt in contact with an inner peripheral surface of the belt, wherein the urging member is provided in the inner peripheral surface side at a position which is adjacent to and upstream of the first roller and which is downstream of the second roller with respect to the movement direction of the belt, and wherein the urging member is supported at an upstream end portion thereof with respect to the movement direction of the belt and includes a plurality of urging portions at a plurality of different positions with respect to the movement direction of the belt, each of the urging portions urging the belt along a widthwise direction crossing the movement direction of the belt.

Further features of the present invention will become apparent from the following description of exemplary embodiments with reference to the attached drawings.

DESCRIPTION OF THE EMBODIMENTS

An image forming apparatus according to the present invention and an urging member will be described with reference to the drawings.

Embodiment 1

1. General Constitution and Operation of Image Forming Apparatus

Figure 1:
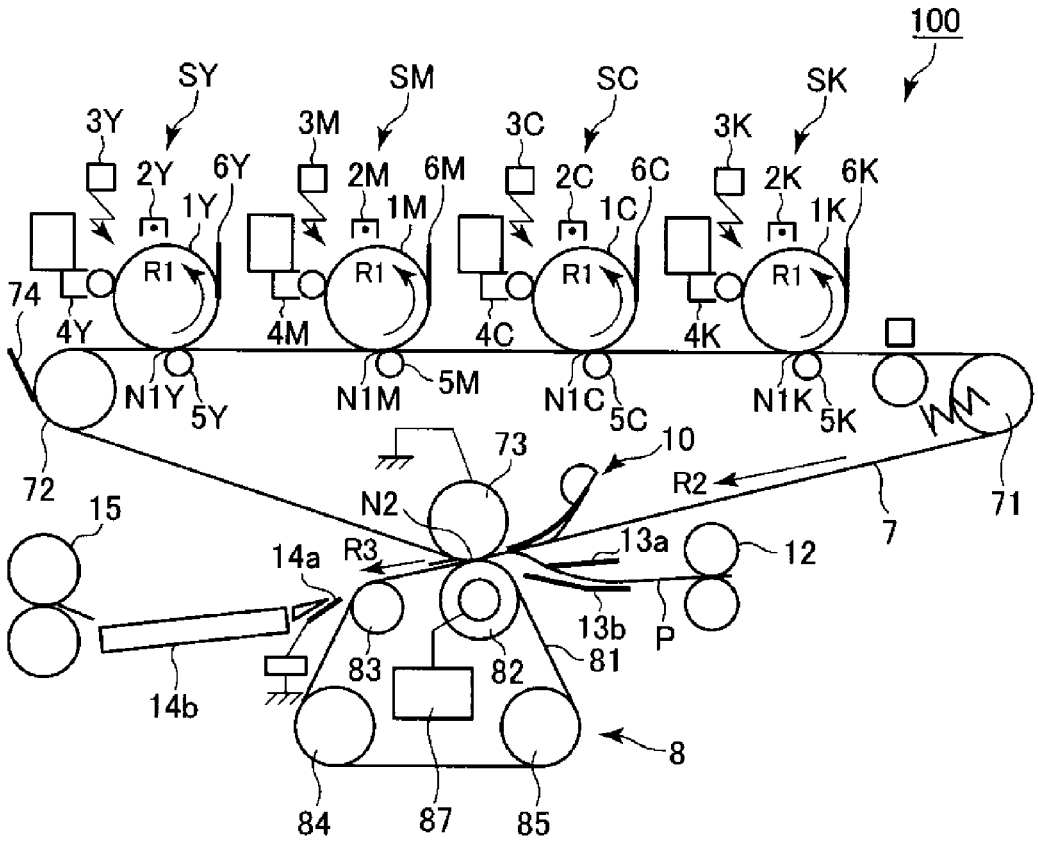
FIG. 1 is a schematic sectional view of an image forming apparatus according to Embodiment 1 of the present invention.

FIG. 1 is a schematic sectional view of an image forming apparatus 100 according to Embodiment 1 of the present invention.

The image forming apparatus 100 in this embodiment is a tandem laser beam printer which is capable of forming a full-color image using an electrophotographic type and which employs an intermediary transfer type.

The image forming apparatus 100 includes, as a plurality of image forming portions (stations), first to fourth image forming portions SY, SM, SC and SK for forming images of yellow (Y), magenta (M), cyan (C) and black (K), respectively. In this embodiment, constitutions and operations of these four image forming portions SY, SM, SC and SK are substantially the same except that the colors of toners used in a developing step described later are different from each other. Accordingly, in the following, in the case where particular distinction is not required, suffixes Y, M, C and K for representing elements for associated colors are omitted, and the elements will be collectively described.

The image forming portion S includes a photosensitive drum 1 which is a rotatable drum-shaped electrophotographic photosensitive member as a first image bearing member. The photosensitive drum 1 is rotationally driven in an arrow R1 direction. At a periphery of the photosensitive drum 1 of the image forming portion S, along a rotational direction of the photosensitive drum 1, the following process devices are provided in the listed order. First, a charger 2 as a charging means is disposed. Next, an exposure device (laser scanner) 3 as an exposure means is disposed. Next, a developing device 4 as a developing means is disposed. Next, primary transfer rollers 5 which are roller-shaped primary transfer members as primary transfer means are disposed. Next, a drum cleaning device 6 as a photosensitive member cleaning means is disposed.

A surface of the rotating photosensitive drum 1 is electrically charged substantially uniformly to a predetermined polarity (negative in this embodiment) and a predetermined potential by the charger. The charged photosensitive drum 1 is exposed to light depending on image information by the exposure device 3, so that an electrostatic latent image (electrostatic image) depending on the image information is formed on the photosensitive drum 1. The electrostatic latent image formed on the photosensitive drum 1 is developed (visualized) with the toner as a developer by the developing device 4, so that the toner image is formed on the photosensitive drum 1. In this embodiment, a reverse developing method is used. That is, the toner charged to the same polarity as a charge polarity of the photosensitive drum 1 is deposited on an exposed portion of the photosensitive drum 1 where an absolute value of the potential is lowered by exposing to light the surface of the photosensitive drum 1 after the photosensitive drum 1 is uniformly charged.

Incidentally, the electrostatic latent image formed by the exposure device 3 is a group of small dotted images, and by changing a density of the dotted images, it is possible to change a density of the toner image to be formed on the photosensitive drum 1. In this embodiment, each of the color toner images is about 1.5-1.7 in maximum density, and is about 0.4-0.6 mg/cm$^2$ in toner amount per unit area at the maximum density.

As a second image bearing member, an intermediary transfer belt 7 constituted by a rotatable endless belt is provided in contact with the surfaces of the photosensitive drums 1Y, 1M, 1C, 1K of the image forming portions SY, SM, SC, SK. The intermediary transfer belt 7 is stretched by a plurality of stretching rollers (supporting members) including a tension roller 71, a driving roller 72, and a secondary transfer opposite roller 73. The tension roller 71 maintains the tension of the intermediary transfer belt 7 at a constant level. The driving roller 72 transmits a driving force from a driving motor (not shown) as a driving means to the intermediary transfer belt 7 and thus moves (rotates) the intermediary transfer belt 7. The intermediary transfer belt 7 is rotationally driven by the driving roller 72 in an arrow R1 direction in FIG. 1. In this embodiment, a peripheral speed of the intermediary transfer belt is 250-300 mm/sec. To the tension roller 71, a force such that the intermediary transfer belt 7 is pushed from an inner peripheral surface (back surface) side toward an outer peripheral surface (front surface) side is applied by a force of a spring as an urging means. In this embodiment, by this force, a tension of about 2-5 kg is applied to the intermediary transfer belt 7 with respect to a feeding direction. The secondary transfer opposite roller 73 opposes a secondary transfer roller 82 (described later) via the intermediary transfer belt 7 and a secondary transfer belt 81 (described later), so that a secondary transfer portion (secondary transfer nip) N2 is formed.

In this embodiment, as the intermediary transfer belt 7, an endless belt having 3-layer structure including a resin layer, an elastic layer and a surface layer in the order from a back surface side to a front surface side is used. As a resin material constituting the resin layer, a material such as polyimide or polycarbonate is used. Further, a thickness of the resin layer is about 70-100 μm. As an elastic material constituting the elastic layer, a material such as urethane rubber or chloroprene rubber is used. Further, a thickness of the elastic layer is about 200-250 μm. As a material of the surface layer, a material which decreases a depositing force of the toner onto the surface of the intermediary transfer belt 7 to facilitate transfer of the toner onto the recording material at the secondary transfer portion N2 is preferred. For example, as a base material, it is possible to use one species or two or more species of resin materials such as polyurethane, polyester and epoxy resin, or elastic materials such as rubber (e.g., butyl rubber) and elastomer. In this base material, one species or two or more species (or in which particle size thereof are different from each other) of materials, e.g., powder or particles of fluorine-containing resin material or the like, for enhancing a lubricating property by decreasing surface energy can be dispersed and used. A thickness of the surface layer may preferably be about 5-10 μm. The intermediary transfer belt 7 is adjusted so that a volume resistivity thereof is $1\times10^9$-$1\times10^{14}$ Ω·cm by adding an electroconductive agent, such as carbon black, for adjusting an electrical resistance value.

On the back surface side of the intermediary transfer belt 7, the primary transfer rollers 5Y, 5M, 5C, 5K are disposed corresponding to the photosensitive drums 1Y, 1M, 1C, 1K, respectively. Each primary transfer roller 5 is urged toward an associated photosensitive drum 1, so that a primary transfer portion (primary transfer nip) N1 where the intermediary transfer belt 7 and the photosensitive drum 1 contact each other is formed. Further, on the front surface side of the intermediary transfer belt 7, at a position opposing the secondary transfer opposite roller 73, a secondary transfer device 8 as a secondary transfer means is provided. The secondary transfer device 8 includes the secondary transfer belt 81 as a recording material feeding member constituted by an endless belt and includes the secondary transfer roller 82 as a secondary transfer member disposed on the back surface side of the secondary transfer belt 81. The secondary transfer roller 82 is urged toward the secondary transfer opposite roller 73 via the intermediary transfer belt 7 and the secondary transfer belt 81, so that the secondary transfer portion (secondary transfer nip) N2 where the intermediary transfer belt 7 and the secondary transfer belt 81 contact each other is formed. The secondary transfer device 8 will be specifically described later. Further, on the front surface side of the intermediary transfer belt 7, at a position opposing the driving roller 72, an intermediary transfer belt cleaner 74 as an intermediary transfer member cleaning means is provided.

The toner image formed on the photosensitive drum 1 as described above is electrostatically transferred (primary-transferred) onto the rotating intermediary transfer belt 7 by the action of the primary transfer roller 5 at the primary transfer portion N1. At this time, to the primary transfer roller 5, a primary transfer bias (primary transfer voltage) of an opposite polarity (positive in this embodiment) to a normal charge polarity of the toner is applied. As a result, a primary transfer current is supplied to the primary transfer portion N1. For example, during full-color image formation, the respective color toner images formed on the photosensitive drums 1Y, 1M, 1C, 1K are successively transferred superposedly onto the intermediary transfer belt 7 at the respective primary transfer portions N1. As a result, multiple toner images, for a full-color image, obtained by the superposed four color toner images are formed on the intermediary transfer belt 7. A deposited matter such as the toners (primary-transfer residual toners) remaining on the photosensitive drums 1 after the predetermined transfer step is removed and collected from the photosensitive drums 1 by the drum cleaners 6.

The toner images formed on the intermediary transfer belt 7 are sent to the secondary transfer portion N2 by rotation of the intermediary transfer belt 7. On the other hand, the recording material P, such as paper, accommodated in a recording material cassette (not shown) is fed one by one by a feeding roller (not shown) and then is fed to the secondary transfer portion N2 by a registration roller pair 12. The registration roller pair 12 once stops the fed recording material P and then supplies the recording material P to the secondary transfer portion N2 in synchronism with the feeding of the toner images on the intermediary transfer belt 7 to the secondary transfer portion N2. With respect to the feeding direction of the recording material P, on a side upstream of the secondary transfer portion N2, the following guiding members 13*a* and 13*b* for regulating a feeding path of the recording material P are provided. First, on the front surface side of the intermediary transfer belt 7, a secondary transfer upstream upper guiding member 13*a* for regulating behavior such that the recording material P approaches the surface of the intermediary transfer belt 7 is disposed. Further, a secondary transfer upstream lower guiding member 13*b* for regulating behavior such that the recording material P is spaced from the surface of the intermediary transfer belt 7 is disposed. The recording material P passes through between these guiding members 13*a* and 13*b*. That is, by these guiding members 13*a* and 13*b*, a feeding path of the recording material P from the registration roller pair 12 to the secondary transfer portion N2 is regulated.

Then, at the secondary transfer portion N2, the toner images on the intermediary transfer belt 7 are electrostatically transferred (secondary-transferred) onto the recording material P, sandwiched and fed between the intermediary transfer belt 7 and the secondary transfer belt 81, by the action of the secondary transfer device 8. At this time, to the secondary transfer roller 82, a secondary transfer bias (secondary transfer voltage) of an opposite polarity (positive in this embodiment) to the normal charge polarity of the toner is applied. As a result, a secondary transfer current is supplied to the secondary transfer portion N2. A deposited matter such as the toners (secondary-transfer residual toners) remaining on the intermediary transfer belt 7 after the secondary transfer step is removed and collected from the intermediary transfer belt 7 by the intermediary transfer belt cleaner 74.

The recording material P on which the toner images are transferred is separated from the intermediary transfer belt 7 and then from the secondary transfer belt 81, and thereafter is fed to a fixing device 15. In this embodiment, a separation claw 14*a* for suppressing electrostatic winding of the recording material P, separated from the secondary transfer belt 81, about the secondary transfer belt 81 is provided. On a downstream side of the separation claw 14*a*, a pre-fixing feeding device 14*b* for feeding the recording material P to the fixing device 15 is provided. Then, after unfixed toner images are fixed on the recording material P by the fixing device 15, the recording material P is discharged (outputted) to an outside of an apparatus main assembly of the image forming apparatus 100.

In this embodiment, the image forming portions SY, SM, SC, SK constitute a toner image forming means for forming the toner images on the belt.

2. Secondary Transfer Device

Next, the secondary transfer device in this embodiment will be specifically described. The secondary transfer device 8 is an example of a transfer means for electrostatically transferring the toner (image) from the belt at the transfer portion. The secondary transfer device 8 includes the secondary transfer belt 81 constituted by the endless belt. The secondary transfer belt 81 is stretched by a plurality of stretching rollers (supporting members) including the secondary transfer roller 82, a separation roller 83, a tension roller 84 and a driving roller 85. The secondary transfer roller 82 sandwiches the intermediary transfer belt 7 and the secondary transfer belt 81 between itself and the secondary transfer opposite roller 73, so that the secondary transfer portion N2 is formed. The separation roller 83 separates the recording material P, after passing through the secondary transfer portion N2, from the secondary transfer belt 81. The tension roller 84 is urged from the back surface side toward the front surface side of the secondary transfer belt 81 by a spring (not shown) as an urging means, so that a tension is imparted to the secondary transfer belt 81. The driving roller 85 transmits a driving force from a driving motor (not shown) as a driving means to the secondary transfer belt 81 and thus moves (rotates) the secondary transfer belt 81. The secondary transfer belt 81 is rotationally driven in an arrow R3 direction in FIG. 1 by the driving roller 85. The respective rollers are disposed along a rotational direction of the secondary transfer belt 81 in the order of the secondary transfer roller 82, the separation roller 83, the tension roller 84 and the driving roller 85. Each of the secondary transfer roller 82, the separation roller 83 and the tension roller 84 is rotated with rotation of the secondary transfer belt 81.

The secondary transfer roller 82 is constituted by providing, on a core metal (core material), an elastic layer formed with an ion-conductive foamed rubber (NBR rubber). This secondary transfer roller 82 is 24 mm in outer diameter, 6.0-12.0 μm in surface roughness Rz of the surface layer, and $1\times10^5$-$1\times10^7\Omega$ in electric resistance as measured under application of a voltage of 2 kV in an N/N (23° C./50% RH) environment. The elastic layer is 30-40 degrees in Asker-C hardness. Further, to the secondary transfer roller 82, a secondary transfer bias voltage source (high-voltage source) 87 as a secondary transfer bias applying means is connected. The secondary transfer bias voltage source 87 is capable of supplying a variable bias and is constituted so that a desired secondary transfer bias can be applied to the secondary transfer roller 82. By applying the secondary transfer bias to the secondary transfer roller 82, not only the toner images are transferred from the intermediary transfer belt 7 onto the recording material P fed to the secondary transfer portion, but also the recording material P is attracted to the secondary transfer belt 81 by a supplied electrostatic force. In this embodiment, the secondary transfer bias is applied to the secondary transfer roller 82 so that a current of, e.g., +40 to +60 μA flows.

The secondary transfer belt 81 wound around the surface of the secondary transfer roller 82 is moved in the arrow R3 direction in FIG. 1, so that the recording material P attracted to the surface of the secondary transfer belt 81 at the secondary transfer portion N2 is fed to a downstream side. Then, at a time when the recording material P on the secondary transfer belt 81 reaches a position of the separation roller 83 disposed adjacent to and downstream of the secondary transfer roller 82 with respect to the rotational direction of the secondary transfer belt 81, the recording material P is separated from the surface of the secondary transfer belt 81 by curvature of the separation roller 83. Then, the recording material P separated from the secondary transfer belt 81 is fed to the fixing device 15 as described above.

Incidentally, as the secondary transfer belt 81, a belt prepared by adding carbon black or the like as an antistatic agent into the resin material such as polyimide or polyamide may suitably be used. The secondary transfer belt 81 may preferably be about $1\times10^{9}$-$1\times10^{14}$ Ω·cm in volume resistivity and about 0.07-0.1 mm in thickness. The secondary transfer belt 81 may be sufficiently hard, for example, having a value of Young's modulus of 100 MPa or more and 10 GPa or less as measured by a tensile test method (JIS K6301).

3. Urging Member

As described above, the recording material P abuts against the intermediary transfer belt 7 at a leading end thereof with respect to the feeding direction of the recording material P immediately before the recording material P enters the secondary transfer portion N2, so that an impact force such that the intermediary transfer belt 7 and an urging member provided on the back surface of the intermediary transfer belt 7 are vibrated generates. Conventionally, due to this impact force, the urging member cannot sufficiently suppress vibration (waving) of the intermediary transfer belt 7, so that an image defect (leading end portion image defect) such as white void or scattering is generated at the leading end portion of the recording material P.

Such a phenomenon that the urging member cannot completely suppress the vibration (waving) of the intermediary transfer belt 7 is liable to generate when the urging member is disposed so that a position of the urging member fluctuates in the image forming apparatus. For example, the case where the urging member is contacted to the intermediary transfer belt 7 by a sheet(-like) member thereof and then is flexed (bent) or the case where the urging member is not formed with the sheet member but is formed of an elastic material or the urging member is urged by an urging means such as a spring corresponds to this case. The reason why the urging member is disposed so as to fluctuate in position in the image forming apparatus is that when the sheet member is used, the urging member can be disposed to a position in the neighborhood of the secondary transfer portion N2 and thus there is an advantage such that the strong removal can be more effectively suppressed.

In order to suppress the leading end portion image defect as described above, in this embodiment, an urging member 10 having the following constitution is provided. In this embodiment, of the plurality of stretching rollers for the intermediary transfer belt 7, between the secondary transfer opposite roller 73 and the tension roller 71, the urging member 10 for suppressing the vibration (waving) of the intermediary transfer belt 7 is disposed in contact with the back surface of the stretched intermediary transfer belt 7. Of the plurality of stretching rollers, the secondary transfer opposite roller 73 is a stretching roller (first stretching roller) contacting the back surface of the intermediary transfer belt 7 at a position corresponding to the secondary transfer portion N2. Of the plurality of stretching rollers, the tension roller 71 is a stretching roller (second stretching roller) disposed adjacent to and upstream of the first stretching roller with respect to the rotational direction of the intermediary transfer belt 7. In this embodiment, the urging member 10 contacts the back surface of the intermediary transfer belt 7 at a plurality of contact portions spaced from each other with respect to the rotational direction of the intermediary transfer belt 7.

As described above, in this embodiment, the urging member 10 contacts the back surface of the intermediary transfer belt 7 at a plurality of positions upstream of the secondary transfer portion N2 with respect to the rotational direction of the intermediary transfer belt 7. As a result, the vibration of the intermediary transfer belt 7 due to the impact when the leading end of the recording material P abuts (runs) against the intermediary transfer belt 7 can be suppressed and reduced at a plurality of points. For that reason, the urging member 10 can stably suppress the vibration (waving) of the intermediary transfer belt 7 even when the leading end portion of the recording material P enters the secondary transfer portion N2. Accordingly, it is possible to suppress generation of the image defect (leading end portion image defect) such as the white void or the scattering at the leading end portion of the recording material P. This will be described specifically below.

Figure 2:
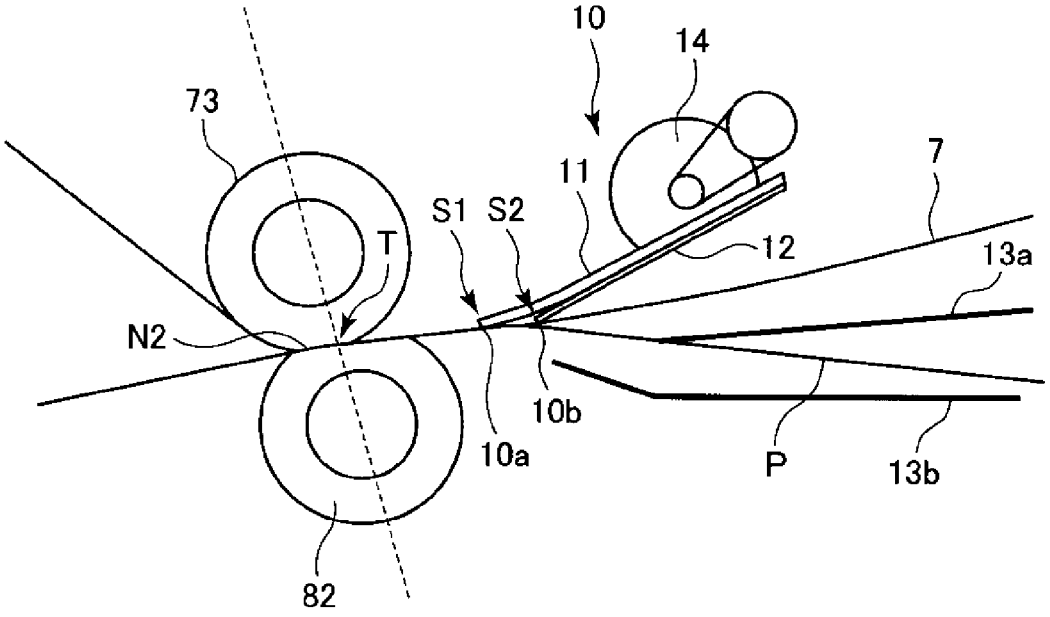
FIG. 2 is a schematic view showing a secondary transfer portion and a neighborhood thereof in Embodiment 1.

FIG. 2 is a sectional view specifically showing the secondary transfer portion N2 and a neighborhood thereof in the image forming apparatus 100 in this embodiment. In FIG. 2, the secondary transfer belt 81 is omitted from illustration. In this embodiment with respect to the rotational direction of the intermediary transfer belt 7, in the neighborhood of a side upstream of the secondary transfer portion N2, the urging member 10 for suppressing the vibration (waving) of the intermediary transfer belt 7 in contact with the back surface of the intermediary transfer belt 7 is provided.

In this embodiment, the urging member 10 includes two sheets consisting of a first sheet (back-up sheet) 11 and a second sheet (back-up sheet) 12. As the first sheet 11 and the second sheet 12, a sheet(-like) member formed of any material such as a resin, a rubber or a metal can be used. In this embodiment, the sheet member formed of the resin was used. The first sheet 11 and the second sheet 12 constitute the sheet member as a whole. The first sheet 11 and the second sheet 12 contact the back surface of the intermediary transfer belt 7 at contact portions 10*a* and 10*b*, respectively, which are spaced from each other. The first and second sheets 11 and 12 are superposed with an angle relative to the back surface of the intermediary transfer belt 7. Of the first and second sheets 11 and 12, the second sheet 12 which is disposed closer to the back surface of the intermediary transfer belt 7 than the first sheet 11 is, is disposed upstream of the first surface 11 with respect to the rotational direction of the intermediary transfer belt 7 at a downstream end portion (hereinafter also referred to as a free end portion) thereof with respect to the rotational direction of the intermediary transfer belt 7. Further, the first and second sheets 11 and 12 contact an inner peripheral surface of the intermediary transfer belt 7 at free end portions thereof, respectively. Specifically, each of the first and second sheets 11 and 12 contacts the back surface of the intermediary transfer belt 7 at an edge portion of the free end portion on the back surface side of the intermediary transfer belt 7 or at a surface thereof in a predetermined range from the edge portion toward the upstream side of the intermediary transfer belt 7 with respect to the rotational direction of the intermediary transfer belt 7.

The second sheet 12 can be bonded onto the first sheet 11 by an appropriate fixing means such as a double-side tape or a screw. In this case, as shown in (a) of FIG. 3, the second sheet 12 can be bonded to the first sheet 11 so that a predetermined range of the second sheet 12 on the free end portion side is movable separately from the first sheet 11. Or, as shown in (b) of FIG. 3, the second sheet 12 may also be bonded to the first sheet 11 so that the second sheet 12 is bonded integrally to the first sheet from a base end portion (opposite from the free end portion with respect to the rotational direction of the intermediary transfer belt 7) to the free end portion of the second sheet. Incidentally, in each of (a) and (b) of FIG. 3, an example in which the first sheet 11 and the second sheet 12 are bonded to each other by a double-side tape 13 as the fixing means is shown.

Here, the downstream end portion, with respect to the rotational direction of the intermediary transfer belt 7, of the contact portion (free end portion) 10*a* of the first sheet 11 with the intermediary transfer belt 7 is a first contact point S1. This first contact point S1 is an example of the downstream end portion, with respect to the rotational direction of the belt, of the contact portion which is closest to the transfer portion among the plurality of contact portions with respect to the rotational direction of the belt.

Further, the downstream end portion, with respect to the rotational direction of the intermediary transfer belt 7, of the contact portion (free end portion) 10*b* of the second sheet 12 with the intermediary transfer belt 7 is a second contact point S2. This second contact point S2 is an example of the downstream end portion, with respect to the rotational direction of the belt, of the contact portion which is adjacent to and upstream of the contact point of the first sheet with respect to the rotational direction of the belt.

Further, as seen in a rotational axis direction of the secondary transfer opposite roller 73, an intersection point of the intermediary transfer belt 7 and a line connecting a rotation center of the secondary transfer opposite roller 73 and a rotation center of the secondary transfer roller 82 is a transfer portion center point T. In this embodiment, the secondary transfer roller 82 is disposed opposed to the secondary transfer opposite roller 73 with respect to a surface (stretching surface) of the intermediary transfer belt 7 stretched between the secondary transfer opposite roller 73 and the tension roller 71 in the case where the urging member 10 is not provided. The transfer portion center point T is an example of an intersection point between an outer common tangential line (A of FIG. 3) between the first stretching roller and the second stretching roller and a perpendicular drawn from a rotation center of the first stretching roller to the outer common tangential line.

In this case, it is preferable that a distance from the first contact point S1 to the transfer portion center point T with respect to the rotational direction of the intermediary transfer belt 7 is 25 mm or less from a viewpoint that the vibration (waving) of the intermediary transfer belt 7 is more effectively suppressed and thus the strong removal (white void of the image due to strong electric field) is more effectively suppressed. Table 1 shows a relationship between the distance from S1 to T and a strong removal suppressing effect obtained by suppressing the vibration (waving) of the intermediary transfer belt 7. In Table 1, "o" represents the case where the strong removal can be sufficiently suppressed, "Δ" represents the case where the strong removal suppressing effect is somewhat lower, but is practically acceptable, and "x" represents the case where the strong removal can generate at a problematic level.

TABLE 1

| | Distance from S1 to T (mm) | | | | |
|---|---|---|---|---|---|
| | <10 | 10-15 | 15-20 | 20-25 | 25< |
| SL*[1] | ○ | ○ | Δ | Δ | x |

*[1]"SL" is the strong removal.

As shown in Table 1, when the distance from S1 to T is larger than 25 mm, the strong removal suppressing effect is not readily obtained. At a point closer to the secondary transfer portion N2, by disposing the urging member 10 so as to suppress the vibration (waving) of the intermediary transfer belt 7, the vibration (waving) of the intermediary transfer belt 7 can be more effectively suppressed. In this embodiment, the first sheet 11 was disposed at a position where the distance from S1 to T is about 7-9 mm. Incidentally, the first contact point S1 is disposed upstream of the secondary transfer portion N2 with respect to the rotational direction of the intermediary transfer belt 7, i.e., upstream of a contact portion of the secondary transfer roller 82 (specifically the secondary transfer belt 81 on the secondary transfer roller 82) with the intermediary transfer belt 7.

Further, it is preferable that a distance from the second contact point S2 to the first contact point S1 with respect to the rotational direction of the intermediary transfer belt 7 is not made excessively large. This is because an effect of suppressing vibration (waving) of the intermediary transfer belt 7, by the first sheet 11, due to the impact when the leading end of the recording material P enters the secondary transfer portion is sufficiently achieved. Specifically, it is preferable that the distance from the second contact point S2 to the first contact point S1 with respect to the rotational direction of the intermediary transfer belt 7 is smaller than the distance from the first contact point S1 to the transfer portion center point T with respect to the rotational direction of the intermediary transfer belt 7. In this embodiment, the second sheet 12 was disposed at a position where a distance from S1 to S2 is about 3-5 mm.

Figure 3:
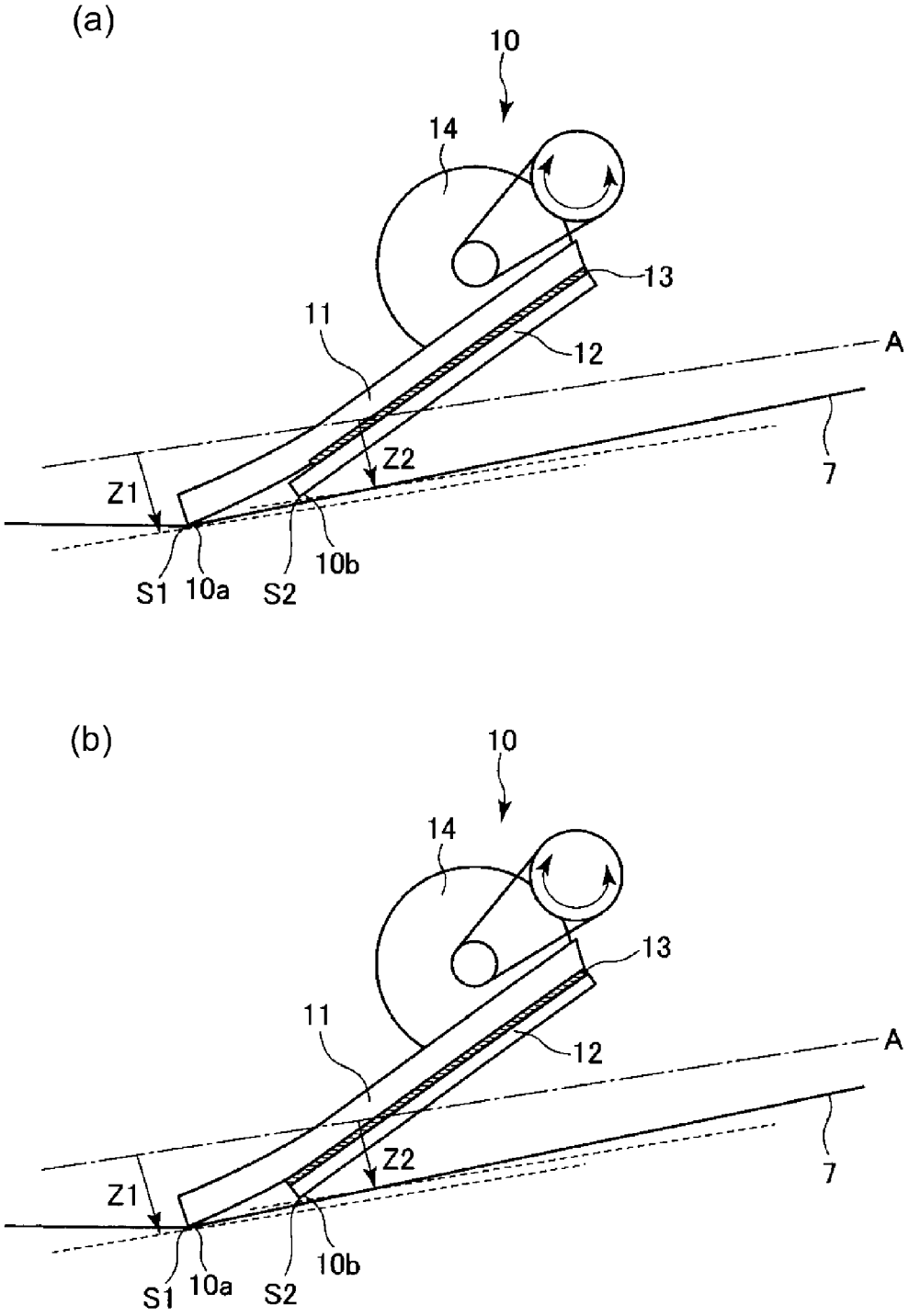
In FIG. 3, (a) and (b) are sectional views each showing an urging member in Embodiment 1.

Here, as shown in FIG. 3, as seen in the rotational axis direction of the secondary transfer opposite roller 73, the outer common tangential line between the secondary transfer opposite roller 73 and the tension roller 71 is A. This outer common tangential line A corresponds to the surface (stretching surface) of the intermediary transfer belt 7 stretched between the secondary transfer opposite roller 73 and the tension roller 71 in the case where the urging member 10 is not provided. In this embodiment, as seen in the rotational axis direction of the secondary transfer opposite roller 73, the urging member 10 projects the intermediary transfer belt 7, stretched between the secondary transfer opposite roller 73 and the tension roller 71, toward the front surface side (outer peripheral surface side) of the intermediary transfer belt 7 relative to the tangential line A described above. In this embodiment, the first sheet 11 and the second sheet 12 are bonded to the supporting member 14, so that the intermediary transfer belt 7 is urged from the back surface side to the front surface side and thus the stretching surface of the intermediary transfer belt 7 is changed. In FIG. 3, the stretching surface (tangential line) A of the intermediary transfer belt 7 when the urging member 10 is not disposed is shown by a chain line. In this case, it is preferable that an amount of changing (projecting) the stretching surface of the intermediary transfer belt 7 at the second contact point S2 by the urging member 10 is made smaller than an amount of changing the stretching surface of the intermediary transfer belt 7 at the first contact point S1 by the urging member 10. That is, the urging member 10 projects the intermediary transfer belt 7, at a plurality of the contact portions, toward the front surface side of the intermediary transfer belt 7 relative to the tangential line A in a direction perpendicular to the tangential line A. Further, it is preferable that the projecting amount at the contact portion, of the plurality of the contact portions, closest to the secondary transfer portion N2 with respect to the rotational direction of the intermediary transfer belt 7 is largest. As a result, weakening of a force of suppressing the vibration (waving) of the intermediary transfer belt 7 in a region from the first contact point S1 to the secondary transfer portion N2 is suppressed, so that the leading end portion image defect can be suppressed more effectively.

Further, in this embodiment, as shown in FIG. 3, the urging member 10 changes the stretching surface of the intermediary transfer belt 7 at the first contact point S1 by Z1 and at the second contact point S1 by Z2. In this embodiment, as the first sheet 1, the sheet member formed of the resin material, such as polyester, in a thickness of about 0.4-0.6 mm was used. Further, the amount Z1 in which the stretching surface of the intermediary transfer belt 7 is changed by the first sheet 11 was made about 1.0-3.0 mm. On the other hand, the amount Z2 in which the stretching surface of the intermediary transfer belt 7 is changed by the second sheet 12 was made smaller than the amount Z1. This is because in the case where Z2 is larger than Z1, a force of pushing the intermediary transfer belt 7 by the first sheet 11 is decreased and the intermediary transfer belt 7 in a region from the first contact point S to the secondary transfer portion N2 is liable to cause the vibration (waving) and thus a suppressing effect of the leading end portion image defect lowers. In this embodiment, as the second sheet 12, a sheet member formed of the same material as that of the first sheet 11 in a thickness of about 0.2-0.3 mm (which is about half of the thickness of the first sheet 11) is used. As a result, a force of pushing the intermediary transfer belt 7 by the second sheet 12 was made weaker than that by the first sheet 11, so that the amount Z2 in which the stretching surface of the intermediary transfer belt 7 was changed by the second sheet 12 was made smaller than the above-described amount Z1 with high reliability. That is, it is preferable that of the plurality of sheets 11 and 12, the sheet contacting the back surface of the intermediary transfer belt 7 at the contact portion closest to the secondary transfer portion N2 with respect to the rotational direction of the intermediary transfer belt 7 has a largest thickness.

Incidentally, the thicknesses the first sheet 11 and the second sheet 12 are substantially uniform with respect to a longitudinal direction (substantially perpendicular to the rotational direction of the intermediary transfer belt 7). Further, lengths of the first sheet 11 and the second sheet 2 with respect to the longitudinal direction are about 330-380 mm, which is longer than the length of the intermediary transfer belt 7 with respect to the longitudinal direction. This is because the first and second sheets 11 and 12 are the resin sheets and therefore when the longitudinal lengths thereof are shorter than that of the intermediary transfer belt 7, there is a liability that the intermediary transfer belt 7 is damaged at longitudinal end portions thereof.

As described above, according to this embodiment, it is possible to suppress the vibration (waving) of the intermediary transfer belt 7 not only during the secondary transfer of the toner image onto a portion, of the recording material P, other than the leading end portion of the recording material P but also when the leading end of the recording material P enters the recording material P. As a result, it is possible to not only suppress the generation of the strong removal but also suppress the image defect (leading end portion image defect), such as the white void or the scattering, which generates at the leading end portion of the recording material P and which was conspicuous during sheet passing of thick paper or the like in the case where the urging member 10 was provided.

Embodiment 2

Next, another embodiment of the present invention will be described. Basic constitutions and operations of the image forming apparatus in this embodiment are the same as those in Embodiment 1. Accordingly, elements having the same or corresponding functions and constitutions are represented by the same reference numerals or symbols and will be omitted from detailed description.

In Embodiment 1, the urging member 10 including the two sheets bonded to each other by the intermediary transfer belt 7 was provided.

Figure 4:
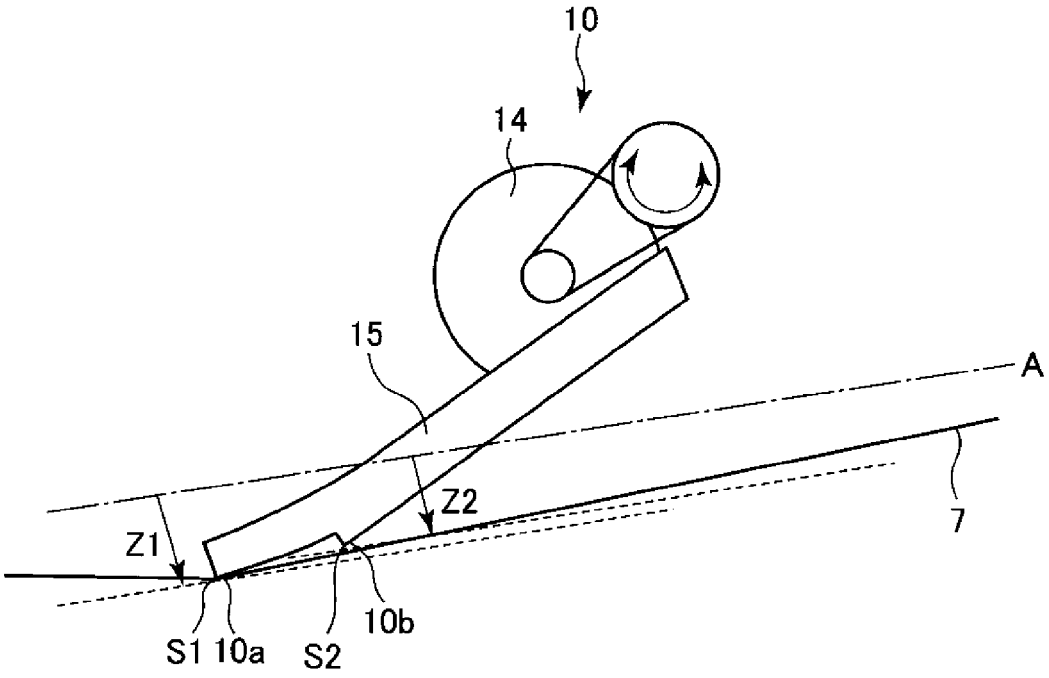
FIG. 4 is a sectional view of an urging member in Embodiment 2.

On the other hand, in this embodiment, as shown in FIG. 4, an urging member 10 includes a single sheet (back-up sheet) 15 provided with two contact portions 10*a* and 10*b*. In this embodiment, the sheet 15 is disposed with an angle relative to the back surface of the intermediary transfer belt 7 and has at least one (one in this embodiment) in the back surface side (inner peripheral surface side) of the intermediary transfer belt 7. This stepped portion is formed so that a thickness of a portion, of the sheet 15, in a downstream side of the sheet 15 with respect to the rotational direction of the intermediary transfer belt 7 is larger than a thickness of the sheet 15. Further, the sheet 15 contacts the back surface of the intermediary transfer belt 7 at downstream end portions thereof, with respect to the rotational direction of the intermediary transfer belt 7, with the stepped portion as a boundary. As the sheet 15, a sheet member formed of any material such as a resin, a rubber or a metal can be used. In this embodiment, the sheet member formed of the resin was used.

In this case, similarly as in Embodiment 1 in which the thickness of the second sheet 12 is made smaller than the thickness of the first sheet 11, it is preferable that the thickness of the sheet 15 is larger at its downstream end portion with respect to the rotational direction of the intermediary transfer belt 7 than at the stepped portion. That is, it is preferable that the thickness of the sheet 15 is larger at its downstream end portion with respect to the rotational direction of the intermediary transfer belt 7 than at the above-described at least one (one in this embodiment) stepped portion. As a result, the amount Z2 in which the urging member 10 changes the stretching surface of the intermediary transfer belt 7 at the second contact point S2 can be made smaller than the amount Z1 in which the urging member 10 changes the stretching surface of the intermediary transfer belt 7 at the first contact point S1 with high reliability.

As described above, according to this embodiment, it is possible to not only obtain an effect similar to the effect of Embodiment 1 but also make the constitution of the urging member 10 simpler than that in Embodiment 1.

Embodiment 3

Next, a further embodiment of the present invention will be described. Basic constitutions and operations of the image forming apparatus in this embodiment are the same as those in Embodiment 1. Accordingly, elements having the same or corresponding functions and constitutions are represented by the same reference numerals or symbols and will be omitted from detailed description.

In Embodiments 1 and 2, the case where there are two contact portions between the urging member 10 and the intermediary transfer belt 7 was described, but three or more contact portions may also be provided.

Figure 5:
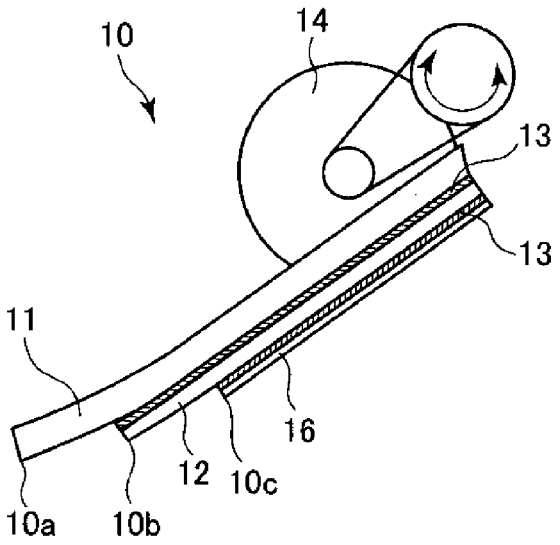
In FIG. 5, (a) and (b) are sectional views each showing Embodiment 3.
Figure 5:
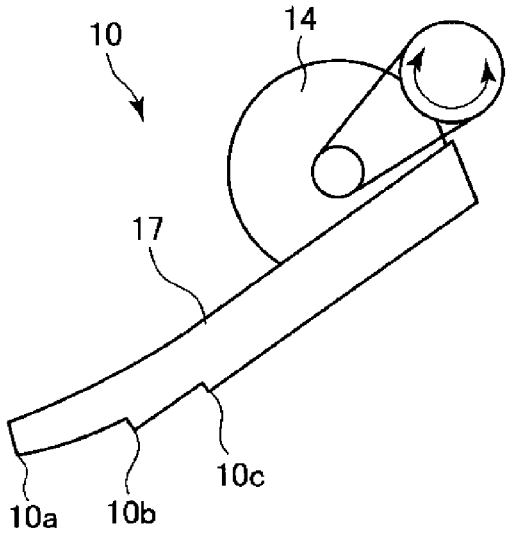
Figure 6:
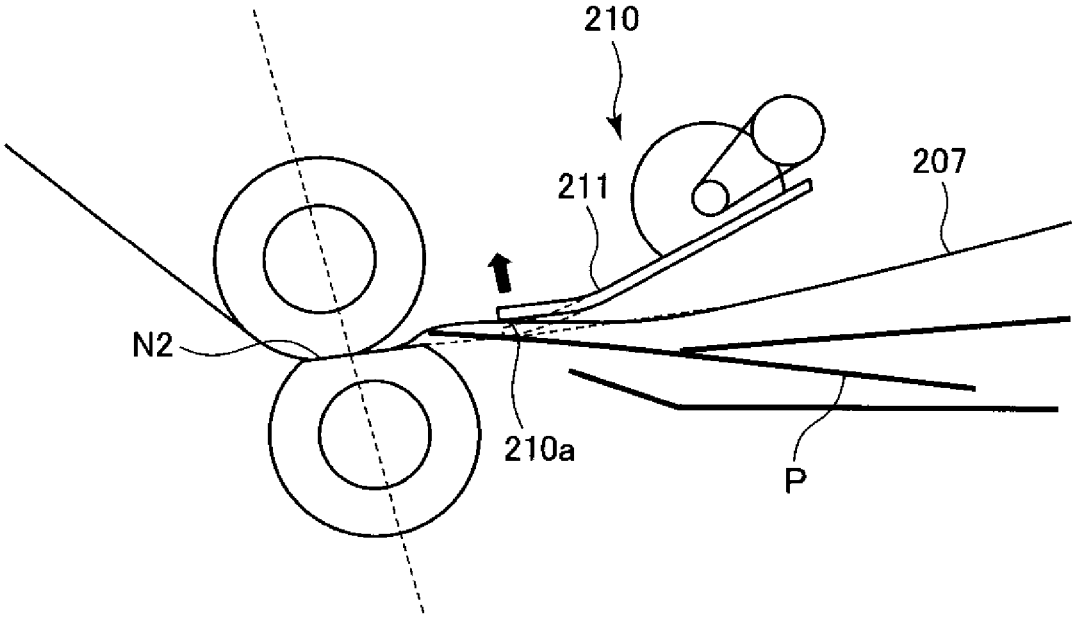
FIG. 6 is a sectional view showing a secondary transfer portion and a neighborhood thereof for illustrating a conventional problem.

In FIG. 5, (a) shows an example of an urging member 10 which includes a plurality of sheets (first sheet 11, second sheet 12, third sheet 16) provided similarly as in Embodiment 1 and which has three contact portions (10*a*, 10*b*, 10*c*). For example, as the first, second and third sheets 11, 12 and 16, sheet members formed of the same resin material can be used and can be bonded to each other by, e.g., the fixing means such as a double-side tape 13. In this case, similarly as in Embodiment 1 in which the thickness of the second sheet 12 is made smaller than the thickness of the first sheet 11, it is preferable that the thickness of the third sheet 16 is made smaller than the thickness of the second sheet 12. That is, it is preferable that the thicknesses of the plurality of sheets 11, 12 and 16 are such that the thickness of the sheet contacting the back surface of the intermediary transfer belt 7 at a more upstream contact portion with respect to the rotational direction of the intermediary transfer belt 7 is smaller than the thicknesses of the other sheets. As a result, with high reliability, the amount in which the urging member 10 projects the intermediary transfer belt 7 at the plurality of contact portions can be made smaller at the more upstream contact portion with respect to the rotational direction of the intermediary transfer belt 7 than at other contact portions.

In FIG. 5, (b) shows an example of an urging member 10 including a single sheet 17 provided with a plurality of contact portions (10*a*, 10*b*, 10*c*) similarly as in Embodiment 1. In this example, the sheet 17 has two stepped portions such that a thickness thereof increases toward the back surface side of the intermediary transfer belt 7 with a position from a downstream side toward an upstream side with respect to the rotational direction of the intermediary transfer belt 7. In this case, similarly as in Embodiment 2 in which the thickness of free end portion is made smaller than the thickness of the stepped portion, it is preferable that the thickness of the downstream stepped portion is made smaller than the thickness of the upstream stepped portion with respect to the rotational direction of the intermediary transfer belt 7. That is, it is preferable that the thicknesses of at least one (two in this embodiment) stepped portion of the sheet 17 are such that the thickness of a more upstream stepped portion with respect to the rotational direction of the intermediary transfer belt 7 is smaller than the thicknesses of stepped portion. As a result, with high reliability, the amount in which the urging member 10 projects the intermediary transfer belt 7 at the plurality of contact portions can be made smaller at the more upstream contact portion with respect to the rotational direction of the intermediary transfer belt 7 than at other contact portions.

As described above, by providing the three or more contact portions between the urging member 10 and the intermediary transfer belt 7, the vibration (waving) of the intermediary transfer belt 7 when the recording material P enters the secondary transfer portion N2 can be dispersed and reduced at more contact portions. As a result, the effect of suppressing the leading end portion image defect can be improved.

OTHER EMBODIMENTS

The present invention was described above based on specific embodiments, but is not limited thereto.

For example, in the above-described embodiments, the secondary transfer device as the secondary transfer means included the endless secondary transfer belt and the secondary transfer roller contacting the secondary transfer belt toward the secondary transfer opposite roller via the intermediary transfer belt. However, the present invention is not limited thereto, but the secondary transfer means may also be a secondary transfer means which does not include the secondary transfer belt but which includes a secondary transfer roller contacting the intermediary transfer belt toward the secondary transfer opposite roller. In the above-described embodiments, the case where the secondary transfer electric field was formed by applying the voltage to the secondary transfer roller was described, but the voltage may also be applied to the stretching roller corresponding to the secondary transfer opposite roller in the above-described embodiments. In this case, the roller corresponding to the secondary transfer roller in the above described embodiments performs the function of the opposite roller.

Further, in the above-described embodiments, the case where the endless belt for feeding the toner images, formed thereon by the toner image forming means, to the transfer portion in order to transfer the toner images from the endless belt onto the recording material was described, but the present invention is not limited thereto. The endless belt may also be a photosensitive (member) belt, an electrostatic recording dielectric (member) belt when the toner images formed thereon by the toner image forming means is fed to the transfer portion in order to transfer the toner images from the belt onto the recording material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-124201 filed on Jun. 19, 2015, which is hereby incorporated by reference herein in its entirety.

What is claimed is:

1. An image forming apparatus comprising:

a movable endless belt;

an image forming unit configured to form a toner image on said belt;

a plurality of rollers configured to stretch said belt at an inner peripheral surface side of said belt, wherein said rollers include a first roller configured to form a transfer portion where the toner image is transferred from said belt onto a recording material and a second roller provided at a position at an upstream side of said first roller with respect to a movement direction of said belt; and an urging member configured to urge said belt toward an outer peripheral surface side of said belt in contact with an inner peripheral surface of said belt along a widthwise direction crossing the movement direction of said belt, wherein said urging member is provided at the inner peripheral surface side at a position which is adjacent to and upstream of said first roller and which is downstream of said second roller with respect to the movement direction of said belt, and wherein said urging member is supported at an upstream end portion thereof with respect to the movement direction of said belt and includes a first urging portion and a second urging portion at two different positions with respect to the movement direction of said belt, said first urging portion and said second urging portion simultaneously urging said belt at the two different positions with respect to the movement direction of said belt.

2. An image forming apparatus according to claim 1, wherein said urging member has a structure in which two sheet members are superposed.

3. An image forming apparatus according to claim 2, wherein of the two sheet members, the sheet member provided at a belt side is thinner than the other sheet member.

4. An image forming apparatus according to claim 1, wherein said first urging portion of said urging member is constituted at a downstream end of said urging member with respect to the movement direction of said belt.

5. An image forming apparatus according to claim 1, wherein said first urging portion and said second urging portion of said urging member are formed in a single member.

6. An image forming apparatus according to claim 5, wherein said second urging portion is constituted by a stepped portion.

7. An image forming apparatus according to claim 1, wherein said first urging portion is disposed adjacently to said second urging portion at a downstream side with respect to the movement direction of said belt, and wherein when a downstream end portion of said first urging portion with respect to the movement direction of said belt is a first contact point and a downstream end portion of said second urging portion with respect to the movement direction of said belt is a second contact point, a distance from the first contact point to a center of the transfer portion with respect to the movement direction of said belt is 25 mm or less.

8. An image forming apparatus according to claim 7, wherein as viewed in a rotational axis direction of said first roller, when an intersection point between an outer common tangential line at said belt side between said first roller and said second roller and a perpendicular line that passes through a rotation center of said first roller and the outer common tangential line is a transfer portion center point, a distance from the second contact point to the first contact point is shorter than a distance from the first contact point to the transfer portion center point with respect to the movement direction of said belt.

9. An image forming apparatus according to claim 8, wherein as viewed in the rotational axis direction, said urging member causes said belt, stretched between said first roller and said second roller, to project toward the outer peripheral surface side of said belt relative to the outer common tangential line.

10. An image forming apparatus according to claim 9, wherein an amount in which said urging member causes said belt to project toward the outer peripheral surface side of said belt relative to the outer common tangential line in a direction perpendicular to the outer common tangential line is greater at the first contact point than at the second contact point.

11. An image forming apparatus according to claim 1, further comprising:

an endless transfer belt; and a transfer roller contacting said endless transfer belt toward said first roller via said endless transfer belt.

12. An image forming apparatus according to claim 1, further comprising a transfer roller configured to urge toward said first roller via said belt.

13. An image forming apparatus according to claim 1, wherein said urging member is formed of a resin material.

14. An image forming apparatus comprising:

a movable endless belt;

an image forming unit configured to form a toner image on said belt;

a plurality of rollers configured to stretch said belt at an inner peripheral surface side of said belt, wherein said rollers include a first roller configured to form a transfer portion where the toner image is transferred from said belt onto a recording material and a second roller provided at a position at an upstream side of said first roller with respect to a movement direction of said belt; and an urging member configured to urge said belt toward an outer peripheral surface side of said belt in contact with an inner peripheral surface of said belt along a widthwise direction crossing the movement direction of said belt, wherein said urging member is provided at the inner peripheral surface side at a position which is adjacent to and upstream of said first roller and which is downstream of said second roller with respect to the movement direction of said belt, and wherein said urging member is supported at an upstream end portion thereof with respect to the movement direction of said belt and includes a plurality of urging portions at a plurality of different positions with respect to the movement direction of said belt, said urging portions simultaneously urging said belt at the plurality of different positions with respect to the movement direction of said belt.

* * * * *